United States Patent [19]

Kovarik

[11] Patent Number: 4,643,252

[45] Date of Patent: Feb. 17, 1987

[54] CARBON DIOXIDE MISCIBLE DISPLACEMENT PROCESS

[75] Inventor: Frank S. Kovarik, Plano, Tex.

[73] Assignee: Atlantic Richfield Company, Los Angeles, Calif.

[21] Appl. No.: 747,738

[22] Filed: Jun. 24, 1985

[51] Int. Cl.[4] ..... E21B 43/22; E21B 43/40

[52] U.S. Cl. ..... 166/263; 166/266

[58] Field of Search ..... 166/263, 268, 273, 274, 166/266, 267

[56] References Cited

U.S. PATENT DOCUMENTS

| | | | |
|---|---|---|---|
| 2,669,306 | 2/1954 | Teter et al. | 166/274 X |
| 3,126,951 | 3/1964 | Santourian | 166/274 X |
| 3,157,230 | 11/1964 | Connally, Jr. et al. | 166/274 |
| 3,240,271 | 3/1966 | Ortloff | 166/263 |
| 3,330,342 | 7/1967 | Holm | 166/263 |
| 3,354,953 | 11/1967 | Morse | 166/263 X |
| 3,459,265 | 8/1969 | Buxton et al. | 166/263 |
| 3,465,823 | 9/1969 | Jacoby et al. | 166/263 |
| 4,467,868 | 8/1984 | Adamache | 166/274 X |
| 4,558,740 | 12/1985 | Yellig, Jr. | 166/274 X |

*Primary Examiner*—George A. Suchfield

*Attorney, Agent, or Firm*—M. David Folzenlogen; Michael E. Martin

[57] ABSTRACT

There is provided a reliable carbon dioxide miscible displacement process wherein a propane-rich in place oil transition zone is created by huff and puff techniques. The enriched oil transition zone uses less LPG solvent per unit volume and is less critical or has greater tolerance to reservoir conditions than a carbon dioxide process would otherwise have if the propane were injected as a displacing slug. The huff stage of injection of the propane material may be followed by a period of shut in. The process may be repeated several times. Propane injection also demethanizes the zone around the injection well, thereby removing methane which interferes with development of miscibility between carbon dioxide and in place oil. After creation of the transition zone, carbon dioxide with or without other fluids is injected to displace oil from the reservoir.

4 Claims, No Drawings

CARBON DIOXIDE MISCIBLE DISPLACEMENT PROCESS

BACKGROUND OF THE INVENTION

This invention relates to a carbon dioxide miscible displacement process utilizing a special transition zone. More specifically, prior to carbon dioxide oil miscible displacement of a subsurface oil-bearings reservoir, there is created a transition zone of demetanized oil enriched with propane with or without heavier hydrocarbons. The transition zone is created by one or more propane huff and puff sequences.

The production of oil is enhanced by various displacement techniques which are generally classified as miscible and immiscible and which may be conducted at any time during an oil recovery program. In these displacement techniques, the force of an injected fluid propels oil within the formation toward a producing well or horizon. Two types of immiscible displacement processes involve flooding the reservoir with carbonated water or with carbon dioxide at a pressure below the miscible pressure. Three types of miscible displacement processes are the miscible slug process, the enriched gas or condensing gas process, and the high pressure gas process. A extremely large variety of miscible recovery processes have been disclosed. But, in general, these processes may be considered as a variation of or a combination of one of the three basic miscible processes. Quasi miscible chemical flooding processes have also been developed. Some of these chemical processes utilize foam and others utilize surfactants which greatly reduce the surface tension between the displacing fluid and the in place oil.

This invention relates to the use of carbon dioxide to miscibly displaced oil from a reservoir. Carbon dioxide generally builds miscibility in the same way that the high pressure gas process builds miscibility, but the carbon dioxide does this at a lower pressure. Because carbon dioxide does not have first contact miscibility with the oil and must build miscibilty by a series of enrichments and exchanges with the in place oil, it has been proposed to inject a bank or slug of propane solvent ahead of the carbon dioxide. Propane solvent slug sizes vary from a few hundredths of the reservoir pore volume to ten to twelve percent of the pore volume. The solvent is injected as a relatively narrow transitional displacing phase between oil and the carbon dioxide. Materials other than propane may be employed to provide a combination slug. Water and other additives have also been combined or alternately injected with the propane solvent to partially influence unit displacement of the slug of solvent. When the propane solvent is mixed with water, the process is still a miscible flood process in that the propane acts as a distinct phase of the mixture. In addition to economic factors, there are serious problems involved in the propane miscible slug processes. Unless an expensively large solvent slug is used, it is difficult to form and maintain a uniform flood front of sufficient thickness and breath to prevent loss or depletion of the band of solvent. If the solvent band is broken or depleted, miscibility is lost and an immiscible drive results. The miscibility cannot be reestablished unless an additonal solvent slug is injected. Because of these problems, it has been proposed to inject enriched carbon dioxide slugs. For example it has been proposed to add propane and propane plus hydrocarbons to the carbon dioxide to enhance miscibility with the oil.

As previously stated, in the carbon dioxide miscible process, miscibility is built only by multiple contacts between the oil and the displacing fluid unless sufficient hydrocarbon solvent is used to create first contact miscibility. the injected carbon dixiode fluid enriches the oil and the oil enriches the injected fluid until a transition zone of miscibility is established. The leading edge of this zone is substantially miscible with the oil and is very much like oil, except possibly for some relatively small precipitated heavy oil phases. The trailing edge of the zone is miscible with the carbon dioxide and is very much like the carbon dioxide fluid. Inside the transition zone, all contiguous fluids are miscible at their leading and trailing edges. In the carbon dioxide miscible displacement processes, the process is pressure dependent. In many cases, carbon dioxide miscible displacement processes require a pressure greater than desirable for the reservoir. This may be caused by the properties of the reservoir oil or by the nature of the formation. It is to be especially noted that methane interferes with miscibility between oil and carbon dioxide. In addition, it is often impratical or undesirably costly to achieve and maintain the relatively high pressures needed for miscibility. In many reservoirs, these relatively high pressures also adversely affect sweep efficiency.

In the carbon dioxide displacing process, depending on the reservoir, one or more problems may result from such factors as gravity override or segregation, viscous fingering, reservoir stratification and the like. In horizontal displacements, such factors affect both the horizontal areal sweep and the vertical sweep. These factors especially influence carbon dioxide miscible displacement processes, including a propane slug followed by carbon dioxide.

It is standard practice to employ laboratory testing and reservoir data to establish and start a reservoir program; therefore, the principles involved in these processes are well known. But tests concerning carbon dioxide displacements are frequently subject to uncertainties especially as to the minimum pressure required to create a miscible zone and to problems involving deasphalting or leaving some high molecular weight components in the test core. It, therefore, would be advantageous to provide a carbon dioxide miscible process wherein less propane is required and wherein miscibility can be achieved more confidently at a given pressure. The pressure may be kept as low as practical, thereby allowing for more confidentally designing the process, overcoming a part of the gravity override and viscous fingering problems encountered in miscible displacement processes, and using less carbon dioxide gas because at a lower pressure the gas is less dense and thereby occupies more formation volume per standard cubic foot of gas with the same oil production.

SUMMARY OF THE INVENTION

It is a primary object of this invention to provide a reliable carbon dioxide miscible displacement process. The process uses huff and puff techniques to create a zone of oil enriched in propane material and depleted of methane around an injection well before injecting carbon dioxide to build miscibility. In comparison to the propane slug process, the transition zone of this invention is created in a manner which permits use of less propane material per unit volume and which is less critical or has greater tolerance to reservoir conditions than the carbon dioxide process would otherwise have if the propane were injected as an intermediate displacing slug between carbon dioxide and oil.

Accordingly, in the huff part of the process of this invention, propane with or without heavier hydrocarbons is injected through an injection well into the oil-bearing formation. Thereafter, in the puff part of the process, the injection well is back flowed to produce fluids from the reservoir. The injection of the propane material may be followed by a period of shut in to better disperse the propane material in the oil. The propane material enriches the reservoir oil with intermediate hydrocarbons thereby making it more miscible to carbon dioxide at a lower pressure and with less multiple contacts. The propane enrichment also demethanizes the zone around the injection well, thereby removing methane which interferes with development of miscibility between carbon dioxide and in place oil. The methane is flowed from the injection well when the propane material is back flowed from the well. Also the propane material may be recovered during back flow and reused in a subsequent injection/back flowing sequence. After the desired number of propane material injection/back flowing steps have been carried out, carbon dioxide displacement is initiated through the injection well to displace oil toward one or more producing wells or horizons.

The carbon dioxide displacement process may be combined with any of the known processes for controlling mobility and preventing gravity override, for example, the carbon dioxide may be injected as a foam or injected in a way that develops carbon dioxide foam.

DETAILED DESCRIPTION

This invention involves a multiple stage process to recover oil from a subterranean reservoir. The invention uses a propane material to create an enriched oil transition zone around an injection well. In this disclosure the words "propane material" mean that the material is a hydrocarbon containing propane with or without heavier hydrocarbons and contains less than one mole percent methane. The propane material may contain some ethane, but for the most part ethane is considered to be like carbon dioxide in nature in so far as miscible displacement is concerned, and, therefore, is thought to be of little advantage over carbon dioxide.

The reservoir has at least one injection point and one production point which are spaced apart one from the other. Access to the injection and production points will be through wellbores, and the points may be spaced laterally, vertically or diagonally spaced from each other in any pattern or multiple pattern or at any appropriate spacing.

One stage of the method centers on generation of a propane enriched transition zone around the injection well. The transition zone is generated by huff and puff techniques in a manner which more uniformly disperses propane material and thereby improves oil displacement in a later stage by carbon dioxide. It is significant that the propane material does not contain appreciable methane. The propane material is injected at a bottom hole pressure and in a manner such that the propane material is forced through at least a portion of the reservoir between the injection and producing points for the primary purpose of generating a transition zone of oil enriched with the lighter intermediate propane material hydrocarbons. Injection of the propane material also causes a decrease in methane saturation in the oil in the area contacted by the propane material. This demethanizes the transition zone and enhances the miscibility between the oil in the transition zone and carbon dioxide at a lower pressure. The creation of a wide spread uniform transition zone enriched in propane material and depleted of methane is further assured if after injection of the propane material, the injection wells and producing wells are allowed to remain shut in while the saturation of the in place oil and demethanization occurs and the propane material spreads out. Immediately after injection or more preferably after the period of shut in, the injection well is placed on production and back flowed. Back flowing may be continued until there is no indication of excess propane material from the injection stage being produced or as an alternative, back flow of the propane material and the methane released by injection of the propane material may be stopped as soon as the pressure declines through to about the original reservoir pressure before injection of the propane material. Preferably, the foregoing propane material injection and back flow with or without shut in after injection and before back flow will be carried out at least twice and may be repeated any number of times.

By utilizing the propane material in the manner stated, the propane material in effect creates an enriched oil transition zone which is much greater in areal extent than a miscible slug of the same volume is in prior processes. The enriched oil is also greater in volume than the amount of propane material injected. Thus, the amount of propane material utilized in the process of this invention may use less propane than in a propane miscible slug process or the same amount of propane material may be used to provide a much larger transition zone when the injection of carbon dioxide is commenced. By back flowing the injection well excess propane material may be recovered and not reinjected when carbon dioxide injection is commenced. The recovered propane material may be combined with the carbon dioxide to create a hydrocarbon enriched carbon dioxide displacement fluid.

After creation of the transition zone, carbon dioxide with or without other fluids and additives is injected into the injection point to build up the pressure of the formation around the injection point to a pressure which will build miscibility with the propane material enriched oil in the transition zone. The carbon dioxide injection sweep efficiency and gravity override may be controlled in the many ways previously suggested. The sweep out efficiency is primarily controlled by differences in gravity and mobility between the injected carbon dioxide fluid and the reservoir fluid. Gravity differences tend to cause gravity override especially when vertical permability is present. Differences in mobility between the driving fluid and the displaced fluid tend to cause fingering and the geometry of the sweep pattern to streamline quicker and cause the displacing fluid to break into the producing point. Differences in mobility also increase the tendency of gravity differences to cause the lighter fluid to override. Mobility differences are usually expressed in terms with mobility ratios which are found by dividing the mobility of the dry fluid behind a sweep front by the mobility of the displacing fluid ahead of the front. Mobility is broadly defined as the permeability divided by the viscosity. Carbon dioxide gas tends to have a mobility of at least ten times that of the oil. U.S. Pat. No. 3,096,821 and many other patents mentioned the principles involved. The process of this invention is especially useful with a carbon dioxide foam process like that described in U.S. Pat. No. 3,342,256.

From the foregoing, it can be seen that this disclosure achieves the purpose previously mentioned. Although this invention has been described with a certain degree of particularity, it is to be understood the present disclosure has been made only by way of example and that numerous changes in the details may be resorted to without departing from the spirit and scope of this invention.

What is claimed is:

1. A method of displacing oil in a subsurface oil-bearing formation wherein there is at least one injection well and at least one producing well comprising:

a. injecting a propane containing fluid into said formation through said injection well, thereby enriching in place oil with said propane containing fluid;

b. ceasing injection of said propane containing fluid and shutting in said injection well for a period of time;

c. thereafter, producing fluids from said injection well from said formation, and d. thereafter, injecting a fluid containing substantial carbon dioxide into said formation through said injection well to displace said oil enriched in said propane containing fluid toward said producing well.

2. A method of displacing oil in a subsurface oil-bearing formation wherein there is at least one injection well and at least one producing well comprising:

a. injecting a propane containing fluid into said formation through said injection well, thereby enriching in place oil with said propane containing fluid;

b. ceasing injection of said propane containing fluid and shutting in said injection well for a period of time;

c. thereafter, producing fluids from said injection well from said formation;

d. carrying out steps "a", "b" and "c" at least twice; and e. thereafter, injecting a fluid containing substantial carbon dioxide into said formation through said injection well to displace said oil enriched in said propane containing fluid toward said producing well.

3. A method of displacing oil in a subsurface oil-bearing formation wherein there is at least one injection well and at least one producing well comprising:

a. injecting a propane containing fluid into said formation through said injection well, thereby enriching in place oil with said propane containing fluid;

b. ceasing injection of said propane containing fluid at said injection well;

c. thereafter, producing fluids from said formation by backflowing fluids into said injection well; and d. thereafter, injecting a fluid containing substantial carbon dioxide into said formation through said injection well to displace said oil enriched in said propane containing fluid toward said producing well.

4. The method set forth in claim 3 including the step of:

recovering propane from the fluids produced during the backflowing of said injection well.

* * * * *